US009008894B2

(12) United States Patent
Bishop et al.

(10) Patent No.: US 9,008,894 B2
(45) Date of Patent: Apr. 14, 2015

(54) AUTOMOBILE MILEAGE NOTIFICATION SYSTEM

(75) Inventors: Ronald D. Bishop, Trabucco Canyon, CA (US); Brian M. Boling, Knoxville, TN (US)

(73) Assignee: Procon, Inc., Knoxville, TN (US)

( * ) Notice: Subject to any disclaimer, the term of this patent is extended or adjusted under 35 U.S.C. 154(b) by 1334 days.

(21) Appl. No.: 12/187,951

(22) Filed: Aug. 7, 2008

(65) Prior Publication Data

US 2009/0043445 A1 Feb. 12, 2009

Related U.S. Application Data

(60) Provisional application No. 60/954,617, filed on Aug. 8, 2007.

(51) Int. Cl.

| | |
|---|---|
| ***G01C 21/00*** | (2006.01) |
| ***G07C 5/00*** | (2006.01) |
| ***G07C 5/08*** | (2006.01) |
| *G01M 17/007* | (2006.01) |
| *G06Q 50/00* | (2012.01) |

(52) U.S. Cl.

CPC ..... *G07C 5/008* (2013.01); *G07C 5/085* (2013.01)

(58) Field of Classification Search

CPC ..... G07C 5/008; G07C 5/085
IPC ..... G07C 5/008, 5/085
See application file for complete search history.

(56) References Cited

U.S. PATENT DOCUMENTS

| | | | | |
|---|---|---|---|---|
| 5,442,553 | A | 8/1995 | Parrillo | |
| 5,445,347 | A | 8/1995 | Ng | |
| 5,464,000 | A | 11/1995 | Pursifull et al. | |
| 5,732,074 | A | 3/1998 | Spaur et al. | |
| 5,758,300 | A | 5/1998 | Abe | |
| 5,796,613 | A * | 8/1998 | Kato et al. | 701/214 |
| 5,797,134 | A | 8/1998 | McMillan et al. | |
| 5,799,249 | A | 8/1998 | Kennedy, III et al. | |
| 5,815,071 | A | 9/1998 | Doyle | |
| 5,825,283 | A | 10/1998 | Camhi | |
| 5,832,394 | A | 11/1998 | Wortham | |
| 5,884,202 | A | 3/1999 | Arjomand | |
| 5,931,878 | A | 8/1999 | Chapin, Jr. | |
| 5,974,356 | A | 10/1999 | Doyle et al. | |
| 6,009,363 | A | 12/1999 | Beckert et al. | |
| 6,064,299 | A | 5/2000 | Lesesky et al. | |
| 6,064,970 | A | 5/2000 | McMillan et al. | |
| 6,073,987 | A | 6/2000 | Lindberg et al. | |
| 6,154,658 | A | 11/2000 | Caci | |

(Continued)

FOREIGN PATENT DOCUMENTS

| | | |
|---|---|---|
| DE | 102005019408 | 11/2006 |
| DE | 102005056945 | 2/2007 |

(Continued)

*Primary Examiner* — Khoi Tran
*Assistant Examiner* — Dale Moyer
(74) *Attorney, Agent, or Firm* — Luedeka Neely Group, P.C.

(57) ABSTRACT

The application describes a system for notifying a vehicle owner regarding service due for a vehicle based on the vehicle's accumulated mileage. The system determines vehicle mileage based on GPS data, determines whether the mileage has exceeded a threshold, transmits a wireless signal from the vehicle to a notification service provider computer when the threshold is exceeded, and sends a notice from the notification service provider to the dealer and/or customer to indicate that vehicle service is due.

11 Claims, 2 Drawing Sheets

(56) References Cited

U.S. PATENT DOCUMENTS

| | | | | |
|---|---|---|---|---|
| 6,225,898 | B1 | 5/2001 | Kamiya et al. | |
| 6,253,129 | B1 | 6/2001 | Jenkins et al. | |
| 6,295,492 | B1 | 9/2001 | Lang | |
| 6,330,499 | B1 | 12/2001 | Chou et al. | |
| 6,370,449 | B1 | 4/2002 | Razavi et al. | |
| 6,427,101 | B1 | 7/2002 | Diaz et al. | |
| 6,505,106 | B1 | 1/2003 | Lawrence et al. | |
| 6,526,335 | B1 | 2/2003 | Treyz et al. | |
| 6,529,723 | B1 | 3/2003 | Bentley | |
| 6,594,579 | B1 | 7/2003 | Lowery et al. | |
| 6,604,033 | B1 | 8/2003 | Banet et al. | |
| 6,636,790 | B1 | 10/2003 | Lightner et al. | |
| 6,711,474 | B1 * | 3/2004 | Treyz et al. | 701/1 |
| 6,732,031 | B1 | 5/2004 | Lightner et al. | |
| 6,879,962 | B1 | 4/2005 | Smith et al. | |
| 7,129,825 | B2 | 10/2006 | Weber | |
| 7,138,916 | B2 | 11/2006 | Schwartz et al. | |
| 7,142,844 | B2 | 11/2006 | Obredovich et al. | |
| 7,310,509 | B2 | 12/2007 | Bristow et al. | |
| 7,480,551 | B1 | 1/2009 | Lowrey et al. | |
| 2002/0173885 | A1 | 11/2002 | Lowery et al. | |
| 2002/0188506 | A1 | 12/2002 | Smith | |
| 2003/0095038 | A1 | 5/2003 | Dix | |
| 2003/0114965 | A1 | 6/2003 | Fiechter et al. | |
| 2006/0200286 | A1 * | 9/2006 | Kumagai et al. | 701/35 |
| 2006/0206576 | A1 | 9/2006 | Obradovich et al. | |
| 2006/0250272 | A1 | 11/2006 | Puamau | |
| 2007/0005202 | A1 | 1/2007 | Breed | |
| 2007/0124046 | A1 | 5/2007 | Ayoub et al. | |
| 2008/0042875 | A1 | 2/2008 | Harrington et al. | |
| 2008/0147245 | A1 | 6/2008 | Koepf et al. | |
| 2008/0228346 | A1 | 9/2008 | Lucas et al. | |
| 2008/0255888 | A1 | 10/2008 | Berkobin et al. | |
| 2008/0294690 | A1 | 11/2008 | McClellan et al. | |
| 2008/0319665 | A1 | 12/2008 | Berkobin et al. | |

FOREIGN PATENT DOCUMENTS

| | | |
|---|---|---|
| EP | 0816820 | 1/1998 |
| WO | 0070530 | 11/2000 |

* cited by examiner

AUTOMOBILE MILEAGE NOTIFICATION SYSTEM

This nonprovisional application claims priority to U.S. provisional patent application No. 60/954,617 filed Aug. 8, 2007.

FIELD

This invention relates to the field of wireless communication systems. More particularly, this invention relates to a system for transmitting a signal to notify an automobile dealer or owner when the vehicle has met or exceeded a certain mileage threshold and for providing notification that service is due.

BACKGROUND AND SUMMARY

Automobile dealers spend about $250 per vehicle in direct mailings to car owners who have purchased a new vehicle to remind the owners of the need for service that should be performed at certain mileage intervals. In many cases, due to the inability to obtain accurate odometer readings or accurately predict when a vehicle has reached or is about to reach various mileage thresholds, the notices sent to the owners will either be too early or too late.

What is needed, therefore, is a system for automatically determining a vehicle's mileage and providing notifications to the vehicle owner that service is due when the vehicle has exceeded various mileage thresholds, such as by way of an email, text message, or right-time advertisement.

The present invention determines vehicle mileage based on accumulated GPS data, determines whether the mileage has met or exceeded a predetermined threshold stored in a vehicle-mounted device, transmits a wireless signal from the vehicle to a central data hub when the threshold is exceeded, and sends a notice from the central data hub to the dealer and/or vehicle owner to indicate that service is due.

BRIEF DESCRIPTION OF THE DRAWINGS

Further advantages of the invention are apparent by reference to the detailed description in conjunction with the figures, wherein elements are not to scale so as to more clearly show the details, wherein like reference numbers indicate like elements throughout the several views, and wherein.

DETAILED DESCRIPTION

Figure 1:
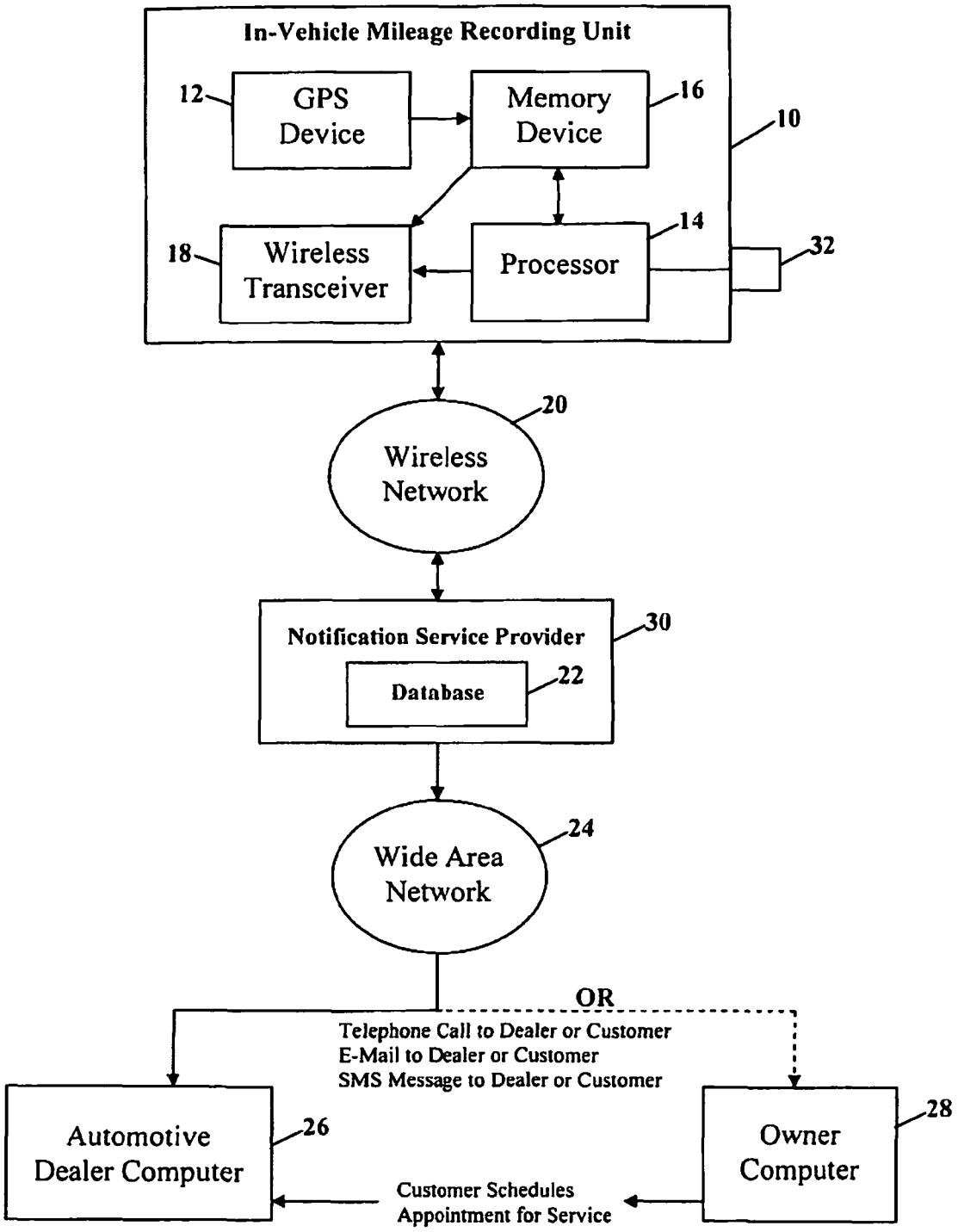
FIG. 1 depicts an apparatus for notifying a vehicle owner regarding service due for a vehicle based on the vehicle's mileage.
Figure 2:
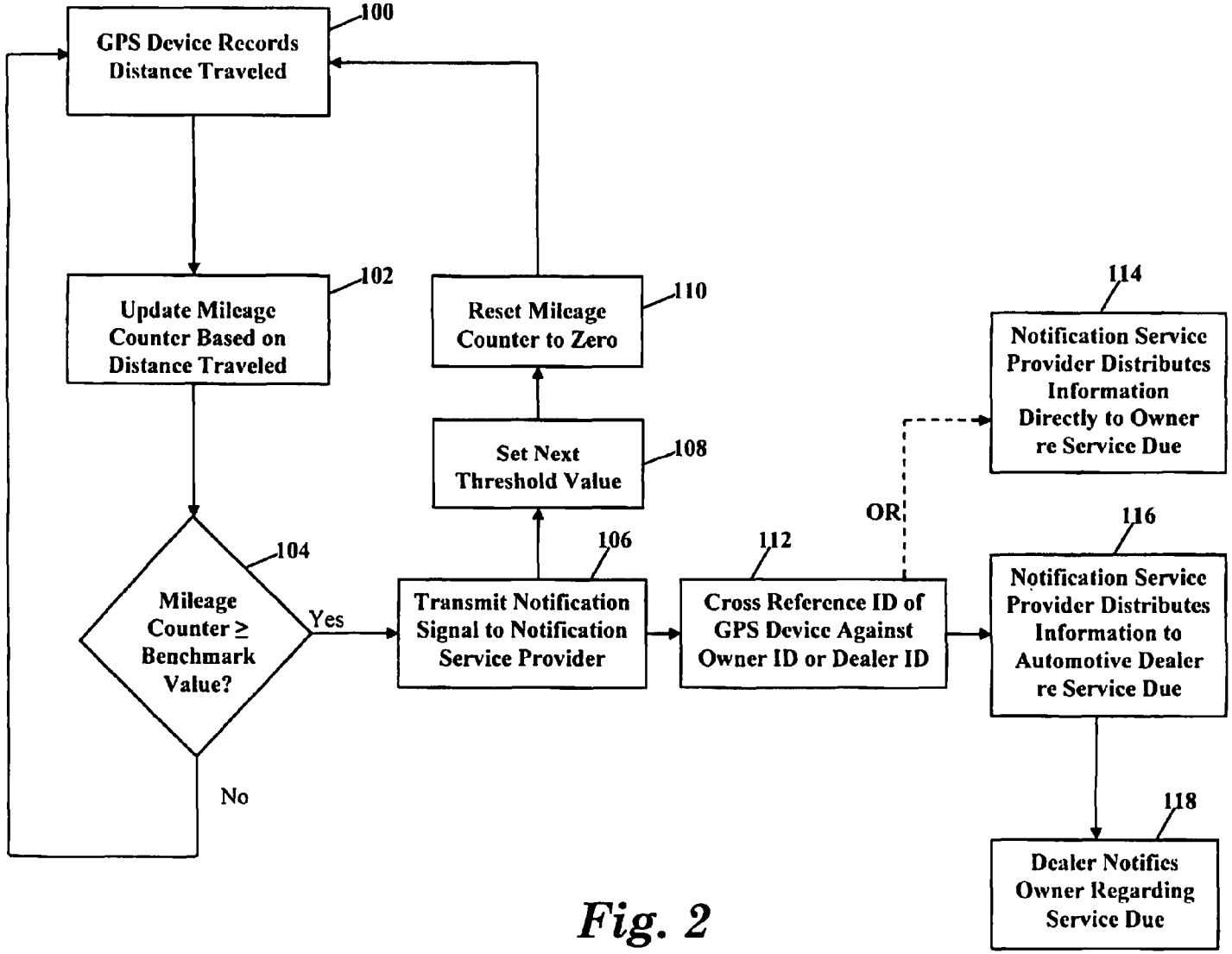
FIG. 2 depicts a method for notifying a vehicle owner regarding service due for a vehicle based on the vehicle's mileage.

Shown in FIGS. 1 and 2 are an apparatus and method for providing a notification regarding service due for a vehicle based on the vehicle's mileage. An in-vehicle mileage recording/transmission unit 10 includes a global positioning system (GPS) device 12, a processor or controller 14, a memory device 16 and a wireless transceiver 18. The GPS device 12 continuously records location data, date/time and accumulated distance traveled, such as in one-second intervals (step 100 in FIG. 2). This data is stored in an event file in the memory device 16 (step 102). Also stored in the memory device 16 is a programmable benchmark or variable threshold values for automated notification parameters.

In a preferred embodiment of the invention, the components of the in-vehicle mileage recording/transmission unit 10 are contained in a single housing that may be installed in an out-of-sight location within the dashboard or under the hood of the vehicle.

As discussed in more detail below, the threshold values may be reprogrammed remotely using signals transmitted to the in-vehicle mileage recording/transmission unit 10. These parameters include a distance-traveled parameter, also referred to herein as vehicle mileage. The distance-traveled data is recorded as an absolute value, including any and all distances traveled by the vehicle in either the forward or reverse directions.

Once the stored distance-traveled value equals or just exceeds the mileage threshold value (step 104), the processor 14 activates the wireless transceiver 18 to initiate a wireless data session with a wireless network 20 (step 106). For example, the wireless transceiver 18 may be a transceiver operating according to the Global System for Mobile (GSM) communication protocol or other cellular telephone protocol. The wireless transceiver 18 transmits a notification signal via the wireless network 20 to a notification service provider computer system 30, such as a system operated by PROCON, Inc. in Orange County, Calif. The notification signal includes vehicle-specific identification information that uniquely identifies the vehicle in which the unit 10 is installed or the unit 10 from which the signal was transmitted. The notification signal also preferably includes a parameter indicating the mileage threshold that has been exceeded (such as 5,000 miles or 30,000 miles).

Once the notification signal has been successfully transmitted, the next threshold value may be set (step 108) and the mileage counter can be reset to zero (step 110). In one embodiment of the invention, these steps are performed automatically based on firmware instructions executed by the processor 14 of the in-vehicle unit 10. In another embodiment, these steps are initiated based on a transmission from the notification service provider 30 to the in-vehicle unit 10 via the wireless network 20.

Upon receipt of the notification signal, the notification service provider computer 30 cross-references the identification information against data in the database 22 that identifies the owner of the vehicle and/or the automobile dealer who sold the vehicle to the owner and/or a third-party vehicle service company that has acquired rights to receive the notification information (step 112). The notification service provider 30 then sends information to the owner (step 114), to the dealer (step 116), or to both indicating that the vehicle's mileage has reached (or is about to reach) a certain value, such as 5000 miles, at which a first vehicle service should be performed. This notification information is preferably sent in an electronic format via the Internet or a wireless data communication network to the dealer computer 26 or to the vehicle owner computer 28. If this information is sent to the dealer computer 26, the dealer may then wish to send the owner a mailing or other communication inviting the owner to make an appointment to service the vehicle (step 118).

In some preferred embodiments, the in-vehicle mileage recording/transmission unit 10 periodically transmits the accumulated vehicle mileage value to the notification service provider computer 30 via the wireless transceiver 18 and the wireless network 20. This transmission also includes the vehicle identification information. The notification service provider computer 30 then accesses the appropriate records in the database 22 for the identified vehicle and compares the accumulated mileage value to a mileage threshold value stored in the database 22 for the particular vehicle. If the accumulated mileage value exceeds the stored threshold value, the notification service provider 30 sends information to the owner, to the dealer, or to both indicating that the vehicle's mileage has reached a certain value indicating that vehicle service is due. In this embodiment, the mileage thresholds are maintained in the database 22 of the notification service provider computer 22 rather than in the memory 16 of the in-vehicle unit 10. This reduces the memory requirements of the in-vehicle unit 10 and eliminates any need to transmit signals from the notification service provider 30 to the in-vehicle unit 10 to reset accumulated mileage values or threshold values.

In some embodiments, the in-vehicle unit 10 includes an On-Board Diagnostics (OBD) connector 32 as shown in FIG. 1. This connector 32 is operable to connect to a mating OBD connector in the vehicle. Through this OBD connection, the processor 14 of the in-vehicle unit 10 can access the Vehicle Identification Number (VIN) of the vehicle, and the VIN may be transmitted from the unit 10 to the notification service provider 30 along with the mileage notification signal. In this embodiment, VINs of vehicles are maintained in the database 22 of the notification service provider 30 rather than, or in addition to, the serial numbers of the in-vehicle units. In this way, any in-vehicle unit 10 may be used in any vehicle, and the notification service provider 30 need only maintain the VINs in its records.

In some embodiments of the invention, the entity acting as the notification service provider also provides the complete end-to-end service for the vehicle owner. This service would include coordinating with the automobile dealer service departments, sending notifications directly to the vehicle owners on behalf of the dealer service departments, and actually setting the appointments.

The communication from the notification service provider to the owner or dealer may be in the form of an email message, SMS text message, telephone message, postcard mailing or other form of communication.

This system may also be used to provide notification of service due at other mileage intervals, such as 30,000 miles and 60,000 miles.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An apparatus for providing notification when a vehicle mileage threshold has been exceeded, the apparatus comprising:

a global positioning system (GPS) receiver for determining cumulative distance traveled by a vehicle based on changes in vehicle location coordinates;

a memory device for storing the cumulative distance and one or more mileage threshold values;

a wireless transceiver for transmitting a notification signal via a wireless communication network to indicate when the cumulative distance traveled by the vehicle exceeds the one or more mileage threshold values;

a processor for accessing the cumulative distance and the one or more mileage threshold values from the memory device, for comparing the cumulative distance to the one or more mileage threshold values, and for automatically activating the wireless transceiver to transmit the notification signal when the processor determines that the cumulative distance exceeds the one or more mileage threshold values;

a housing in which the GPS receiver, the memory device, the processor and the wireless transceiver are contained, the housing configured to be mounted within a passenger compartment or an engine compartment of the vehicle; and an On-Board Diagnostics connector for connecting to a mating connector in the vehicle, wherein the processor is operable to access a vehicle identification number of the vehicle via the On-Board Diagnostics (OBD) connector, and wherein the wireless transceiver is operable to transmit the vehicle identification number in the notification signal.

2. The apparatus of claim 1 wherein the memory device stores a first mileage threshold corresponding to a mileage interval at which a first vehicle service should be performed.

3. The apparatus of claim 1 wherein the wireless transceiver is operable to receive a mileage reset signal, and the processor is operable to reset the cumulative distance traveled by the vehicle to a predetermined value when the reset signal is received.

4. The apparatus of claim 1 wherein the wireless transceiver is operable to receive a mileage threshold change signal, and the processor is operable to change one or more of the mileage threshold values stored in the memory device when the mileage threshold change signal is received.

5. The apparatus of claim 1 wherein the memory device stores at least one identification number that uniquely identifies the apparatus or the vehicle in which the apparatus is installed.

6. A computer-implemented method for providing notification of a vehicle service interval based on vehicle mileage, the method comprising:

(a) using a location determination receiver in a vehicle, determining location coordinates of the vehicle over time;

(b) using a computer processor in the vehicle, determining cumulative distance traveled by the vehicle based on the location coordinates of the vehicle over time;

(c) using the computer processor in the vehicle, storing a mileage threshold value in a memory device in the vehicle;

(d) using the computer processor in the vehicle, comparing the mileage threshold value to the cumulative distance traveled by the vehicle;

(e) using the computer processor in the vehicle, accessing a vehicle identification number from a vehicle data bus in the vehicle;

(f) using a wireless transceiver in the vehicle, transmitting a notification signal from the vehicle to a notification service provider when the cumulative distance traveled by the vehicle exceeds the mileage threshold value, wherein the notification signal includes the vehicle identification number for identifying the vehicle from which the notification signal was transmitted;

(g) using a computer processor associated with the notification service provider, comparing the vehicle identification number to records stored in a central database maintained by the notification service provider to determine an identity of an automotive maintenance service provider to be notified regarding the mileage of the vehicle; and (h) using the computer processor associated with the notification service provider, sending notification information to the automotive maintenance service provider to notify the automotive maintenance service provider that vehicle maintenance service is due based on the mileage of the vehicle.

7. The method of claim 6 wherein step (e) comprises the computer processor in the vehicle accessing the vehicle identification number via an On-Board Diagnostics connector in the vehicle.

8. The method of claim 6 further comprising:

(i) using the computer processor associated with the notification service provider, comparing the vehicle identification number to records stored in the central database to determine an identity of the owner of the vehicle from which the notification signal was transmitted, wherein step (h) further comprises sending the notification information to the automotive maintenance service provider using the computer processor associated with the notification service provider, wherein the notification information includes the identity of the owner of the vehicle.

9. A computer-implemented method for providing notification of a vehicle service interval based on vehicle mileage, the method comprising:

(a) determining location information of a vehicle over time using a global positioning system (GPS) receiver in the vehicle;

(b) determining cumulative distance traveled by the vehicle based solely on the location information determined by the GPS receiver;

(c) accessing a vehicle identification number from a vehicle data bus in the vehicle;

(d) storing a mileage threshold value in a central database maintained by a notification service provider;

(e) automatically and periodically transmitting a notification signal from the vehicle to the notification service provider, wherein the notification signal includes the vehicle identification number for identifying the vehicle from which the notification signal was transmitted and an accumulated mileage value indicative of the cumulative distance traveled by the vehicle;

(f) comparing the mileage threshold value stored in the central database to the accumulated mileage value transmitted from the vehicle;

(g) comparing the vehicle identification number transmitted from the vehicle to records stored in the central database to determine an identity of an automotive maintenance service provider to be notified regarding the mileage of the vehicle; and (h) sending notification information to the automotive maintenance service provider to notify the automotive maintenance service provider that vehicle maintenance service is due based on the mileage of the vehicle.

10. The method of claim 9 wherein step (c) comprises accessing the vehicle identification number via an On-Board Diagnostics connector in the vehicle.

11. The method of claim 9 further comprising:

(i) comparing the vehicle identification number to records stored in the central database to determine an identity of the owner of the vehicle from which the notification signal was transmitted, wherein step (h) further comprises sending the notification information to the automotive maintenance service provider, wherein the notification information includes the identity of the owner of the vehicle.

* * * * *